US005551957A

United States Patent [19]

Cunningham et al.

[11] Patent Number: 5,551,957

[45] Date of Patent: Sep. 3, 1996

[54] COMPOSTIONS FOR CONTROL OF INDUCTION SYSTEM DEPOSITS

[75] Inventors: Lawrence J. Cunningham, Kirkwood; Don P. Hollrah, Manchester; Alexander M. Kulinowski, St. Louis, all of Mo.

[73] Assignee: Ethyl Corporation, Richmond, Va.

[21] Appl. No.: 364,062

[22] Filed: Dec. 27, 1994

Related U.S. Application Data

[63] Continuation of Ser. No. 127,967, Sep. 28, 1993, abandoned, which is a continuation-in-part of Ser. No. 878,969, May 6, 1992, abandoned.

[51] Int. Cl.[6] ..... C10L 1/22; C10L 1/30

[52] U.S. Cl. ..... 44/347; 44/359; 44/360

[58] Field of Search ..... 44/347, 359, 360

[56] References Cited

U.S. PATENT DOCUMENTS

| | | | |
|---|---|---|---|
| Re. 29,488 | 12/1977 | Gautreaux | 44/68 |
| 2,818,417 | 12/1957 | Brown et al. | 44/359 |
| 2,839,552 | 6/1958 | Shapiro et al. | 260/429 |
| 2,915,440 | 12/1959 | Pearson et al. | 204/59 |
| 2,953,587 | 9/1960 | Clinton et al. | 260/429 |
| 3,007,781 | 11/1961 | Billmeier et al. | 44/56 |
| 3,030,195 | 4/1962 | Ewan | 44/56 |
| 3,037,038 | 5/1962 | Johnston et al. | 260/429 |
| 3,041,155 | 6/1962 | Brown et al. | 44/69 |
| 3,054,740 | 9/1962 | Shroll | 204/158 |
| 3,065,065 | 11/1962 | Sutton et al. | 44/69 |
| 3,100,213 | 8/1963 | Coffield | 260/429 |
| 3,112,789 | 12/1963 | Percy et al. | 158/117.5 |

(List continued on next page.)

FOREIGN PATENT DOCUMENTS

| | | |
|---|---|---|
| 706328 | 3/1965 | Canada . |
| 1082462 | 7/1980 | Canada . |
| 1188891 | 6/1985 | Canada . |
| 2045455 | 1/1992 | Canada . |
| 0078249 | 10/1987 | European Pat. Off. . |
| 0435631 | 7/1991 | European Pat. Off. . |
| 441014 | 8/1991 | European Pat. Off. . |
| 0235280 | 11/1991 | European Pat. Off. . |
| 0466511 | 1/1992 | European Pat. Off. . |
| 0466512 | 1/1992 | European Pat. Off. . |
| 0476196 | 3/1992 | European Pat. Off. . |
| 0476197 | 3/1992 | European Pat. Off. . |
| 476196 | 3/1992 | European Pat. Off. . |
| 526129 | 2/1993 | European Pat. Off. . |
| 1486144 | 9/1977 | United Kingdom . |

OTHER PUBLICATIONS

Kramarenko, G.V., et al.; "Margantsevye Antidetonatory", 128–32. Edited by: Nesmeyanov, A. N. Nauka : Moscow, USSR., 1971.

Faix, Louis J., "A Study of the Effects of Manganese Fuel Additive on Automative Emissions", SAE [Tech.Pap.], 780002, 1978.

Lenane, D. L.; "Effect of MMT on Emissions from Production Cars", SAE [Tech. Pap.], 780003, 1978.

Bailie J. D., et al.; "MMT—A Versatile Antiknock", Natl. Pet. Refiners Assoc., [Tech. Pap.], AM–78–36, 1978.

Lenane, D. L.; "MMT—A Further Evaluation", SAE [Tech. Pap.], 770656, 1977.

Moran, John B.; "The Environmental Implications of Maganese as an Alternate Antiknock", SAE [Tech. Pap.], 750926, 1975.

Faggan, et al.; "An Evaluation of Manganese as an Antiknock in Unleaded Gasoline", SAE [Tech. Pap.], 750925, 1975.

Hurn, R. W., et al.; "Effect of Gasoline Additives on Gaseous Emmisions", U.S. NTIS, PB Rep., PB–253782, Dec. 1974.

Zaytsev, V. A., et al.; "Prospects for the Use of Cyclopentadienyl Maganese Tricarbonyl to Increase the Knock Resistance of Motor Fuels", Margantsevye Antidetonatory, Edited by: Nesmeyanov, A. M. Nauka: Moscow, USSR, pp. 95–104, 1971.

Zabryanskiy, Ye.I., et al.; "Promoting Effect of Cyclopentadienyl Manganese Tricarbonlyl upon its Addition to Ethyl Gasolines", Margantsevye Antidenatory, Edited by: Nesmeyanov, A. N., Nauka: Moscow, USSR, pp. 105–112, 1971.

Lerner, M. O., et al.; "Effect of Antiknock Compounds on the Operational Reliability of Spark Plugs", Margantsevye Antidetonatory, pp. 113–127, Edited by: Nesmeyanov, A. N. Nauka: Moscow, USSR, 1971.

Lerner, M. O., "Combustion of Fuels Containing Cyclopentadienyl Manganese Tricarbonyl (CMT)", Margantsevye Antidetonatory, pp. 73–94, Edited by: Nesmeyanov, A. N., Nauka: Moscow, USSR, 1971.

Chalabov, V. G., et al.; "Study of an Engine with a Maganese–Based Anti–Knox Compound", Nauchno–Issled. Proektn. Inst. Tsvetn. Metall., Armniprotsvetmet, 1975.

Furey, Robert L., et al., "How MMT Causes Plugging of Monolithic Converters", SAE Tech. Paper Series–780004, Feb. 27–Mar. 3, 1978.

Belyea, A. R., "The Cl–2 Manganese Based Additives Reduces the Concentration of $SO_3$in Flue Gases", (translated from Italian), Consolidated Edison Co., Il Calore, 1967.

Brown, J. E., et al.; "A New Manganese Antiknock", Industrial & Engineering Chemistry, vol. 50, No. 10, Oct. 1958.

Goodger, E. M., et al.; "Droplet Ignition as an Indicator of Combustion Knock", Instit. Pet., [Tech. Pap.] IP, IP–80–002, 1980.

(List continued on next page.)

*Primary Examiner*—Jerry D. Johnson
*Attorney, Agent, or Firm*—Dennis H. Rainear

[57] ABSTRACT

The combination of a fuel-soluble succinimide detergent/dispersant, a fuel-soluble liquid carrier or induction aid therefor, and a fuel-soluble cyclopentadienyl manganese tricarbonyl compound can sharply reduce the formation or accumulation of engine deposits such as intake valve deposits in internal combustion engines. In fact, such compositions can function synergistically whereby the effectiveness of a highly effective succinimide-based deposit control additive can be improved by the addition thereto of the manganese compound, the latter not known to be a substance that reduces deposits.

9 Claims, No Drawings

U.S. PATENT DOCUMENTS

| | | | |
|---|---|---|---|
| 3,127,351 | 3/1964 | Brown et al. | 44/359 |
| 3,130,213 | 4/1964 | Harper | 260/429 |
| 3,144,857 | 8/1964 | Hesselberg | 123/27 |
| 3,153,073 | 10/1964 | Wilkinson | 260/429 |
| 3,179,506 | 4/1965 | Henderson | 44/66 |
| 3,197,414 | 7/1965 | Wood, Jr. | 252/386 |
| 3,202,141 | 8/1965 | Lovell | 123/1 |
| 3,261,674 | 7/1966 | Condo | 44/69 |
| 3,282,662 | 11/1966 | Henderson | 44/69 |
| 3,303,132 | 2/1967 | Leonardi | 252/49.7 |
| 3,307,928 | 3/1967 | Chaikivsky et al. | 44/347 |
| 3,348,932 | 10/1967 | Kukin | 44/4 |
| 3,443,916 | 5/1969 | Rolfe | 44/4 |
| 3,526,545 | 9/1970 | Abowd, Jr. | 134/3 |
| 3,533,765 | 10/1970 | Kerley et al. | 48/197 |
| 3,558,291 | 1/1971 | Abowd, Jr. | 44/68 |
| 3,558,292 | 1/1971 | Abowd, Jr. | 44/68 |
| 3,565,592 | 2/1971 | Mehmedbasich | 44/347 |
| 3,615,293 | 10/1971 | Hnizda | 44/66 |
| 3,682,702 | 8/1972 | Hnizda | 134/41 |
| 3,692,503 | 9/1972 | Kuklin | 44/4 |
| 3,718,444 | 2/1973 | Hnizda | 44/66 |
| 3,755,195 | 8/1973 | Hnizda | 252/386 |
| 3,883,320 | 5/1975 | Struki | 44/68 |
| 3,891,401 | 6/1975 | Watson | 44/68 |
| 3,926,580 | 12/1975 | Gautreaux | 44/68 |
| 3,926,581 | 12/1975 | Plonsker | 44/68 |
| 3,927,992 | 12/1975 | Kerley | 44/4 |
| 3,948,618 | 4/1976 | Niebylski | 44/66 |
| 3,950,145 | 4/1976 | Niebylski | 44/68 |
| 3,958,955 | 5/1976 | Gautreaux | 44/68 |
| 3,966,429 | 6/1976 | Sprague et al. | 44/68 |
| 4,005,992 | 2/1977 | Niebylski et al. | 44/68 |
| 4,005,993 | 2/1977 | Niebylski et al. | 44/68 |
| 4,028,065 | 6/1977 | Sprague et al. | 44/68 |
| 4,039,300 | 8/1977 | Chloupek et al. | 44/347 |
| 4,047,900 | 9/1977 | Dorn et al. | 44/68 |
| 4,048,061 | 9/1977 | Blytas | 208/251 R |
| 4,052,171 | 10/1977 | Niebylski | 44/68 |
| 4,067,699 | 1/1978 | Lukasiewicz | 44/66 |
| 4,082,517 | 4/1978 | Niebylski | 44/68 |
| 4,139,349 | 2/1979 | Payne | 44/68 |
| 4,140,491 | 2/1979 | Allain et al. | 44/56 |
| 4,141,693 | 2/1979 | Feldman et al. | 44/68 |
| 4,155,718 | 5/1979 | Graiff | 44/359 |
| 4,175,927 | 11/1979 | Niebylski | 44/68 |
| 4,191,536 | 3/1980 | Niebylski | 44/63 |
| 4,207,078 | 6/1980 | Sweeney et al. | 44/68 |
| 4,222,746 | 9/1980 | Sweeney et al. | 44/68 |
| 4,236,898 | 12/1980 | Davis et al. | 44/66 |
| 4,240,801 | 12/1980 | Desmond, Jr. | 44/57 |
| 4,266,946 | 5/1981 | Niebylski | 44/68 |
| 4,266,947 | 5/1981 | Hartle et al. | 44/68 |
| 4,317,657 | 3/1982 | Niebylski | 44/360 |
| 4,390,345 | 6/1983 | Somarjai | 44/63 |
| 4,437,436 | 3/1984 | Graiff et al. | 123/1 A |
| 4,548,616 | 10/1985 | Sung et al. | 44/443 |
| 4,647,292 | 3/1987 | Jessup et al. | 44/66 |
| 4,664,677 | 5/1987 | Dorer et al. | 44/68 |
| 4,674,447 | 6/1987 | Davis | 123/1 A |
| 4,844,717 | 7/1989 | Croudace et al. | 44/71 |
| 4,877,416 | 10/1989 | Campbell | 44/412 |
| 4,968,321 | 11/1990 | Sung et al. | 44/347 |
| 5,113,803 | 5/1992 | Hollrah et al. | 123/1 A |
| 5,114,435 | 5/1992 | Abramo et al. | 44/347 |
| 5,242,469 | 9/1993 | Sakakibara et al. | 44/347 |
| 5,256,165 | 10/1993 | Herbstman et al. | 44/347 |
| 5,393,309 | 2/1995 | Cherpeck | 44/347 |

OTHER PUBLICATIONS

Lichenstein, Ivan E., et al.; "MMT Plugging of Oxidation Catalysts on Ceramic & Metal Supports During Engine Dyno Studies of Catalyst Durability", SAE [Tech. Pap.], 78005, 1978.

Benson, Jack D., "Manganese Fuel Additive (MMT) Can Cause Vehicle Problems", SAE [Tech. Pap.], 770655, 1977.

Gureyev, A. V., et al.; "Effect of Organsulfur Compounds on Acceptance of Antiknock Compounds by Gasolines", (translation from Russian), Margantsevye Antidentonatory, pp. 133–154, Edited by: Nesmeyanov, A. N., Nauka: Moscow, USSR, 1971.

Nesmeyanov, A. N., et al.; "Antiknock Effectiveness of Derivatives of Cyclopentadienyl Manganese Tricarbonyl (CMT)", (translation from Russian), Margantsevye Antidetonatory, pp. 61–64, Edited by: Nesmeyanov, A. N., Nauka: Moscow, USSR, 1971.

Nesmeyanov, A. N., et al.; "Antiknock Effectiveness of Some Organomaganese Compounds", (translation from Russian), Margantsevye Antidetonatory, pp. 53–60, Edited by: Nesmeyanov, A. N., Nauka: Moscow, USSR, 1971.

Aronov, D. M., "Results of Performance Tests of Gasolines Containing An Manganese Antiknock Compound", (translation from Russian), Margantsevye Antidetonatory, pp. 165–186, Edited by: Nesmeyanov, A. N., Nauka: Moscow, USSR, 1971.

Kramarenko, G. V., et al., "Results of Long–Term Performance Tests of the Volga Automobile Running on Gasoline Containing a Manganese Antiknock Compound", Margantsevye Antidetonatory, pp. 187–191, Edited by: Nesmeyanov, A. N., Nauka: Moscow, USSR, 1971.

Gureyev, A. A., et al. "Composition of Deposits in an Engine Running on Gasolines Containing Various Antiknock Compounds", Margantsevye Antidetonatory, pp. 55–59, Edited by: Nesmeyanov, A. N., Nauka: Moscow, USSR, 1971.

Gureyev, A. A., et al., "Effect of a Manganese Antiknock Compound on the Physical & Chemical Properties & Performance of Motor Gasolines", Margantsevye Antidetonatory, pp. 155–164, Edited by: Nesmeyanov, A. N., Nauka: Moscow, USSR, 1971.

Kobzova, R. I., et al., "Improving the Termooxidation Stability of Dispersing Agents of Greases by Using Additives", Margantsevye Antidetonatory, pp. 6–12, Edited by: Nesmeyanov, A. N., Nauka: Moscow, USSR, 1971.

Zubarev, N. D., et al.; "Lowering Carbon Depostion in Ship Diesels", Rybn. Khoz. (Moscow), (9), pp. 52–54, 1977.

Shmidt, M. Z., et al.; "Use of the Manganese Antiknock Compound 2–Ts8 to Increase the Octane Rating of a Gasoline", Neftepereab. Neftekhim. (Moscow), (11), pp. 8–10, 1972.

Mutalibov, A. A., et al.; "Effect of Additives on the Combustion of Fuel for Internal–Combustion Engines", Dokl. Akad. Nauk SSSR, 250(5), pp. 1194–1196, [Phys. Chem.], 1980.

Borisov, A. A., et al.; "Features of the Ignition of Combustible Liquid Mixtures", Dokl. Akad. Nauk SSSR, 247(5), pp. 1176–1179, [Phys. Chem.]. 1979.

Bartels, T. T., et al.; "Determination of Methyl Cyclopentadienyl Manganese Tricarbonyl in JP–4 Fuel by Atomic Absorption Spectrophotometry", At. Absorption Newslett., 8(1), 1969.

Makhov, V. Z., et al.; "Experimental Study of the Effect of CMT Additives to Diesel Fuel on the Process of Carbon--Black Formation", Margantsevye Antidetonatory, Edited by Nesmeyanov, A. N.; Nauka: Moscow, USSR, pp. 192–199, 1971.

Keszthelyi, K., et al.; "Testing the Combustion Properties of Light Fuel Oils", Period, Polytech., Chem. Eng., 21(1), pp. 79–93, 1977.

Riggs, R. J., et al.; "This New Additive Can Boost Octane", Petroleum Refiner, pp. 131–136, Jul. 1958.

Leeper, Thomas A., et al.; "HITEC 3000—An Octane Additive for the Future", 1990 NPRA Annual Meeting, #AM-90-44, 1990.

Pierson, William R., et al.; "Methylcyclopentadienyl Manganese Tricarbonyl: Effect on Manganese Emmissions from Vehicles on the Road", J. Air Pollut. Control Assoc., 28(7), 1978.

Hughmark, G. A., et al.; "A Statistical Analysis of the Effect of MMT Concentration on Hydrocarbon Emmissions", SAE, 9-0225-0393, 800393, 1980.

Bailie, J. D., "MMT: Better Way to Boost Octane", Oil Gas Journal, 74(16), 1976.

Lenane, D. L., "MMT—A Further Evaluation", SAE Fuels & Lubricants Meeting, Tulsa, #770656, 1977.

Otto, K., et al.; "Effects of Mn Deposits from MMT on Automotive Catalysts in the Absence & Presence of Other Fuel Additives", American Chemical Society, 12(2), pp. 181–184, 1978.

Lenane, Denis L., "Effect of a Fuel Additive on Emmission Control Systems", SAE Tech Paper #902097, Int. Fuels & Lubricants Meet, Tulsa, Ok., 1990.

Hammerle, R. H., et al.; "Particulate Emmissions from Current Model Vehicles Using Gasoline with Methylcyclopentadienyl Manganese Tricarbonyl", SAE Technical Paper #912436, 1991.

Hurley, R. G., et al.; "The Effect of Emmissions & Emmssions Component Durability by the Fuel Additive Methylcyclopentadienyl Manganese Tricarbonyl (MMT)", SAE Technical Paper #912437, 1991.

COMPOSTIONS FOR CONTROL OF INDUCTION SYSTEM DEPOSITS

This application is a continuation of application Ser. No. 127,967, filed Sep. 28, 1993, now abandoned which in turn is a continuation in part of prior application Ser. No. 878,969, filed May 6, 1992, now abandoned.

TECHNICAL FIELD

This invention relates to controlling or reducing fuel induction system deposits in internal combustion engines. More particularly this invention relates to detergent/dispersant compositions and to distillate fuels and distillate fuel additive concentrates capable of controlling or reducing the amount of intake valve deposits formed during engine operation.

BACKGROUND

A problem frequently encountered in the operation of gasoline and diesel engines is the formation of undesirable amounts of engine deposits, such as induction system deposits, and especially intake valve or injector deposits.

Prior copending applications Serial No. 648,555 of G. M. Wallace and J. P. Simmonds, Ser. Nos. 737,195 and 760,341 of L. J. Cunningham, and Ser. No. 793,544 of D. J. Malfer, which applications are all assigned to subsidiaries of Ethyl Corporation, describe effective succinimide-based compositions for controlling and/or reducing the severity of problems associated with the formation of engine deposits.

THE INVENTION

This invention relates to the surprising discovery that the combination of a fuel-soluble succinimide-based fuel additive composition such as described in the foregoing applications and a fuel-soluble cyclopentadienyl manganese tricarbonyl compound can sharply reduce the formation or accumulation of engine deposits such as intake valve deposits in internal combustion engines. In fact, compositions of this invention can function synergistically whereby the effectiveness of a highly effective succinimide-based deposit control additive can be improved by the addition thereto of the manganese compound, the latter not known to be a substance that reduces deposits.

This invention provides in one of its embodiments a fuel additive concentrate comprising a fuel-soluble succinimide detergent/ dispersant, a fuel-soluble liquid carrier or induction aid for such detergent/dispersant, and a fuel-soluble cyclopentadienyl manganese tricarbonyl compound. Liquid hydrocarbonaceous fuels containing such additive components constitute another embodiment of this invention. In this connection, the term "hydrocarbonaceous fuel" designates not only a blend or mixture of hydrocarbons commonly referred to as gasoline or diesel fuel, but additionally so-called oxygenated fuels (i.e., fuels with which have been blended ethers, alcohols and/or other oxygen-containing fuel blending components as are used in reformulated gasolines and the like).

One preferred embodiment of this invention is a fuel additive concentrate which comprises:

A) a fuel-soluble product formed by reaction between (a) at least one polyamine and (b) at least one acyclic hydrocarbyl-substituted succinic acylating agent;

B) at least one fuel-soluble carrier fluid selected from 1) a mineral oil having a viscosity index of less than about 90 and a volatility of 50% or less as determined by the test method described in the specification hereof, 2) a poly-α-olefin oligomer having a volatility of 50% or less as determined by the test method described in the specification hereof, and 3) a polyoxyalkylene compound having a molecular weight of greater than about 1500; and C) at least one fuel-soluble cyclopentadienyl manganese tricarbonyl compound.

Another preferred embodiment of this invention involves a fuel composition for internal combustion engines, said fuel composition comprising a major amount of a liquid hydrocarbonaceous distillate fuel and A) a fuel-soluble product formed by reaction between (a) at least one polyamine and (b) at least one acyclic hydrocarbyl-substituted succinic acylating agent;

B) at least one fuel-soluble carrier fluid selected from 1) a mineral oil having a viscosity index of less than about 90 and a volatility of 50% or less as determined by the test method described in the specification hereof, 2) a poly-α-olefin oligomer having a volatility of 50% or less as determined by the test method described in the specification hereof, and 3) a polyoxyalkylene compound having a molecular weight of greater than about 1500; and C) at least one fuel-soluble cyclopentadienyl manganese tricarbonyl compound.

Still another preferred embodiment of this invention is a method of controlling intake valve deposits in internal combustion engines operated on gasoline, which method comprises producing and/ or providing and/or using as the fuel therefor, a fuel composition as described in the immediately preceding paragraph.

These and other embodiments of this invention will be apparent from the ensuing description and ensuing claims.

The surprising properties manifested by compositions of this invention were demonstrated by actual road tests conducted using a BMW 318i vehicle operated on a group of four test fuels. The base fuel used throughout this group of tests was Phillips J fuel. This fuel contains no detergent/ dispersant and no added metal-containing compound. The vehicle was operated under the same conditions with new intake valves at the start of each test. After known mileage accumulation with a given test fuel, the intake valves were removed from the engine and the weight of the valve deposits was determined and averaged for the four intake valves. The four fuels tested in this manner were as follows:

Fuel A—Base fuel as received

Fuel B—Base fuel containing 250 pounds per thousand barrels (ptb) of an additive composition of Example 4 hereinafter except that the methylcyclopentadienyl manganese tricarbonyl was omitted Fuel C—Base fuel containing 0.03125 (i.e., 1/32) g/gal of manganese as methylcyclopentadienyl manganese tricarbonyl Fuel D—Base fuel containing 250 ptb of the additive composition used in Fuel B, and 0.03125 g/gal of manganese as methylcyclopentadienyl manganese tricarbonyl Fuel D was thus representative of the compositions of this invention whereas Fuels A, B, and C were comparative fuels.

Table I summarizes the results of these tests, and Table II sets forth the inspection data of the base fuel used in these tests.

TABLE I

| Fuel Used | Miles of Operation | Average Intake Valve Deposit Weight, mg |
|---|---|---|
| Fuel A | 4,300 | 100 |
| Fuel B | 10,000 | 42 |
| Fuel C | 5,000 | 120 |
| Fuel D | 10,000 | 5 |

TABLE II

| Test Description | Final Result | ASTM Test Method |
|---|---|---|
| Distillation, Gasoline, °F. | | D86 |
| Initial Boiling Temperature | 86 | |
| 05% Evaporated Temperature | 107 | |
| 10% Evaporated Temperature | 124 | |
| 20% Evaporated Temperature | 140 | |
| 30% Evaporated Temperature | 159 | |
| 40% Evaporated Temperature | 187 | |
| 50% Evaporated Temperature | 217 | |
| 60% Evaporated Temperature | 237 | |
| 70% Evaporated Temperature | 256 | |
| 80% Evaporated Temperature | 284 | |
| 90% Evaporated Temperature | 329 | |
| 95% Evaporated Temperature | 368 | |
| End Point | 432 | |
| % Overhead Recovery | 97.4 | |
| % Residue | 1.0 | |
| % Loss | 1.6 | |
| Potential Gum Content, mg | | D873; D381 |
| Potential Residue, Precipitate | <0.1 | |
| Potential Residue, Insoluble Gum | 147.4 | |
| Potential Gum, Soluble Gum | 7.2 | |
| Potential Gum, Total Gum | 154.6 | |
| Acid Number, Total, mg KOH/g | <0.1 | D664 |
| Peroxides, Organic Assay, %/peroxide number | <0.01 | E 298-84 |
| Gravity, °API - 60/60F | 54.8 | D287 |
| Oxidation Stability, minutes | 1440 | D525 |
| Total Sulfur, ppm wt. | 199 | D3120 |
| Reid Vapor Pressure, PSI | 7.4 | D323 |
| Water, Karl Fischer Titration, ppm | 292 | D1744 |
| Gum Content, Washed, mg/l00mL | 0.4 | D381 |
| Gum Content, Unwashed, mg/l00mL | 2.0 | D381 |
| Lead Content, g/gal | <0.001 | D3237 |

In view of the astonishing results described in Table I above, additional tests were performed in a different BMW 318i fuel-injected vehicle. In these tests Fuel E corresponded to Fuel B above except that the additive composition was used at the level of 200 ptb rather than 250 ptb. In Fuel F, which was representative of the compositions of this invention, the base fuel contained 200 ptb of the additive composition used in Fuel B, and 0.03125 g/gal of manganese as methylcyclopentadienyl manganese tricarbonyl. Results from these tests at 5000 and 10,000 miles are summarized in Table III.

TABLE III

| Fuel Used | Miles of Operation | Average Intake Valve Deposit Weight, mg |
|---|---|---|
| Fuel E | 5,000 | 60 |
| Fuel E | 10,000 | 95 |
| Fuel F | 5,000 | 18 |
| Fuel F | 10,000 | 16 |

Succinimide Detergent/Dispersants

The preferred detergent/dispersants are prepared by a process which comprises reacting (1) an ethylene polyamine selected from (a) diethylene triamine, (b) a combination of ethylene polyamines which approximates diethylene triamine in average overall composition, (c) triethylene tetramine, (d) a combination of ethylene polyamines which approximates triethylene tetramine in average overall composition, or (e) a mixture of any two or more of (a) through (d), with (2) at least one acyclic hydrocarbyl substituted succinic acylating agent. The substituent of such acylating agent is characterized by containing an average of about 50 to about 100 (preferably about 50 to about 90 and more preferably about 64 to about 80) carbon atoms. Additionally, the acylating agent has an acid number in the range of about 0.7 to about 1.3 (e.g., in the range of 0.9 to 1.3, or in the range of 0.7 to 1.1), more preferably in the range of 0.8 to 1.0 or in the range of 1.0 to 1.2, and most preferably about 0.9. The detergent/dispersant contains in its molecular structure in chemically combined form an average of from about 1.5 to about 2.2 (preferably from 1.7 to 1.9 or from 1.9 to 2.1, more preferably from 1.8 to 2.0, and most preferably about 1.8) moles of said acylating agent, (2), per mole of said polyamine, (1).

The acid number of the acyclic hydrocarbyl substituted succinic acylating agent is determined in the customary way—i.e., by titration—and is reported in terms of mg of KOH per gram of product. It is to be noted that this determination is made on the overall acylating agent with any unreacted olefin polymer (e.g., polyisobutene) present.

The acyclic hydrocarbyl substituent of the detergent/dispersant is preferably an alkyl or alkenyl group having the requisite number of carbon atoms as specified above. Alkenyl substituents derived from poly-α-olefin homopolymers or copolymers of appropriate molecular weight (e.g., propene homopolymers, butene homopolymers, $C_3$ and $C_4$ α-olefin copolymers, and the like) are suitable. Most preferably, the substituent is a polyisobutenyl group formed from polyisobutene having a number average molecular weight (as determined by gel permeation chromatography) in the range of 700 to 1200, preferably 900 to 1100, most preferably 940 to 1000. The established manufacturers of such polymeric materials are able to adequately identify the number average molecular weights of their own polymeric materials. Thus in the usual case the nominal number average molecular weight given by the manufacturer of the material can be relied upon with considerable confidence.

Acyclic hydrocarbyl-substituted succinic acid acylating agents and methods for their preparation and use in the formation of succinimide are well known to those skilled in the art and are extensively reported in the patent literature. See for example the following U.S. Pat. Nos.

| | | |
|---|---|---|
| 3,018,247 | 3,231,587 | 3,399,141 |
| 3,018,250 | 3,272,746 | 3,401,118 |
| 3,018,291 | 3,287,271 | 3,513,093 |
| 3,172,892 | 3,311,558 | 3,576,743 |
| 3,184,474 | 3,331,776 | 3,578,422 |
| 3,185,704 | 3,341,542 | 3,658,494 |
| 3,194,812 | 3,346,354 | 3,658,495 |
| 3,194,814 | 3,347,645 | 3,912,764 |
| 3,202,678 | 3,361,673 | 4,110,349 |
| 3,215,707 | 3,373,111 | 4,234,435 |
| 3,219,666 | 3,381,022 | 5,071,919 |

When utilizing the general procedures such as described in these patents, the important considerations insofar as the present invention is concerned, are to insure that the hydrocarbyl substituent of the acylating agent contain the requisite number of carbon atoms, that the acylating agent have the requisite acid number, that the acylating agent be reacted with the requisite polyethylene polyamine, and that the reactants be employed in proportions such that the resultant succinimide contains the requisite proportions of the chemically combined reactants, all as specified herein. When utilizing this combination of features, detergent/dispersants are formed which possess exceptional effectiveness in controlling or reducing the amount of induction system deposits formed during engine operation and which permit adequate demulsification performance.

As pointed out in the above listed patents, the acyclic hydrocarbyl-substituted succinic acylating agents include the hydrocarbyl-substituted succinic acids, the hydrocarbyl-substituted succinic anhydrides, the hydrocarbyl-substituted succinic acid halides (especially the acid fluorides and acid chlorides), and the esters of the hydrocarbyl-substituted succinic acids and lower alcohols (e.g., those containing up to 7 carbon atoms), that is, hydrocarbyl-substituted compounds which can function as carboxylic acylating agents. Of these compounds, the hydrocarbyl-substituted succinic acids and the hydrocarbyl-substituted succinic anhydrides and mixtures of such acids and anhydrides are generally preferred, the hydrocarbyl-substituted succinic anhydrides being particularly preferred.

The acylating agent for producing the detergent/dispersants is preferably made by reacting a polyolefin of appropriate molecular weight (with or without chlorine) with maleic anhydride. However, similar carboxylic reactants can be employed such as maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and lower aliphatic esters.

As noted above, the polyamine used in the synthesis reaction for forming the detergent/dispersants is (a) diethylene triamine, (b) a combination of ethylene polyamines which approximates diethylene triamine in overall composition, (c) triethylene tetramine, (d) a combination of ethylene polyamines which approximates triethylene tetramine in overall composition, or (e) a combination of any two or three of, or of all four of (a), (b), (c) and (d). Ordinarily this reactant will comprise a commercially available mixture having the general overall composition approximating that of triethylene tetramine but which can contain minor amounts of branched-chain and cyclic species as well as some linear polyethylene polyamines such as diethylene triamine and tetraethylene pentamine. For best results, such mixtures should contain at least 50% and preferably at least 70% by weight of the linear polyethylene polyamines enriched in triethylene tetramine.

The reaction between the polyamine and the acylating agent is generally conducted at temperatures of 80° C. to 200° C., more preferably 140° C. to 180° C., such that a succinimide is formed. These reactions may be conducted in the presence or absence of an ancillary diluent or liquid reaction medium, such as a mineral lubricating oil solvent. If the reaction is conducted in the absence of an ancillary solvent, such is usually added to the reaction product on completion of the reaction. In this way, the final product is more readily handled, stored and blended with other components. Suitable solvent oils include natural and synthetic base oils having a viscosity (ASTM D 445) of preferably 3 to 12 $mm^2$/sec at 100° C. with the primarily paraffinic mineral oils such as a 500 Solvent Neutral oil being particularly preferred. Suitable synthetic diluents include polyesters, hydrogenated or unhydrogenated poly-α-olefins (PAO) such as hydrogenated or unhydrogenated 1-decene oligomer, and the like. Blends of mineral oil and synthetic oils are also suitable for this purpose.

As used herein, the term succinimide is meant to encompass the completed reaction product from the polyamine and the acylating agent, and is intended to encompass compounds wherein the product may have amide, amidine, and/or salt linkages in addition to the imide linkage of the type that results from the reaction of a primary amino group and an anhydride moiety.

Carrier Fluids

In the practice of this invention particular types of carrier fluids are especially preferred because of their performance capabilities, but others can also be used. The preferred carrier fluids are 1) one or a blend of mineral oils having a viscosity index of less than about 90 and a volatility of 50% or less as determined by the test method described below, 2) one or a blend of poly-α-olefins having a volatility of 50% or less as determined by the test method described below, 3) one or more polyoxyalkylene compounds having an average molecular weight of greater than about 1500, or 4) a mixture of any two or all three of 1), 2) and 3). Preferred are blends of 1) and 2), and blends of 1) and 3).

The test method used for determination of volatility in connection with the carrier fluids of 1) and 2) above is as follows: Mineral oil or poly-α-olefin (110–135 grams) is placed in a three-neck, 250 mL round-bottomed flask having a threaded port for a thermometer. Such a flask is available from Ace Glass (Catalog No. 6954-72 with 20/40 fittings). Through the center nozzle of the flask is inserted a stirrer rod having a Teflon blade, 19 mm wide ×60 mm long (Ace Glass catalog No. 8085-07). The mineral oil is heated in an oil bath to 300° C. for 1 hour while stirring the oil in the flask at a rate of 150 rpm. During the heating and stirring, the free space above the oil in the flask is swept with 7.5 L/hr of air or inert gas (e.g., nitrogen, argon, etc.). The volatility of the fluid thus determined is expressed in terms of the weight percent of material lost based on the total initial weight of material tested.

As noted above, one type of preferred carrier fluid is one or a blend of mineral oils having a viscosity index of less than about 90 and a volatility of 50% or less as determined by the test method described above. Mineral oils having such volatilities that can be used include naphthenic and asphaltic oils. These often are derived from coastal regions. Thus a typical Coastal Pale may contain about 3–5 wt. % polar material, 20–35 wt. % aromatic hydrocarbons, and 50–75 wt. % saturated hydrocarbons and having a molecular weight in the range of from about 300 to about 600. Asphaltic oils usually contain ingredients with high polar functionality and little or no pure hydrocarbon type compounds. Principal polar functionalities generally present in such asphaltic oils include carboxylic acids, phenols, amides, carbazoles, and pyridine benzologs. Typically, asphaltenes contain about 40–50% by weight aromatic carbon and have molecular weights of several thousand. Preferably the mineral oil used has a viscosity at 100° F. of less than about 1600 SUS more preferably less than about 1500 SUS, and most preferably between about 800 and 1500 SUS at 100° F. For best results it is highly desirable that the mineral oil have a viscosity index of less than about 90, more particularly, less than about 70 and most preferably in the range of from about 30 to about 60. The mineral oils may be solvent extracted or hydrotreated oils, or they may be non-hydrotreated oils. The hydrotreated oils are the most preferred type of mineral oils used as carrier fluids in the practice of this invention.

The poly-α-olefins (PAO) which are included among the preferred carrier fluids of this invention are the hydrotreated and unhydrotreated poly-α-olefin oligomers, i.e., hydrogenated or unhydrogenated products, primarily trimers, tetramers and pentamers of α-olefin monomers, which monomers contain from 6 to 12, generally 8 to 12 and most preferably about 10 carbon atoms. Their synthesis is outlined in Hydrocarbon Processing. February 1982, page 75 et seq. and is described in the patents cited hereinafter in this paragraph. The usual process essentially comprises catalytic oligomerization of short chain linear alpha olefins (suitably obtained by catalytic treatment of ethylene). The nature of an individual PAO depends in part on the carbon chain length of the original aolefin, and also on the structure of the oligomer. The exact molecular structure may vary to some extent according to the precise conditions of the oligomerization, which is reflected in changes in the physical properties of the final PAO, particularly its viscosity. Typically, the poly-α-olefins used have a viscosity (measured at 100° C.) in the range of 2 to 20 centistokes (cSt). Preferably, the poly-α-olefin has a viscosity of at least 8 cSt, and most preferably about 10 cSt at 100° C. The hydrotreated poly-α-olefin oligomers are readily formed by hydrogenating poly-α-olefin oligomers using conditions such as are described in U.S. Pat. Nos. 3,763,244; 3,780,128; 4,172,855; 4,218,330; and 4,950,822, the entire disclosures of which are incorporated herein by reference.

The polyoxyalkylene compounds which are among the preferred carrier fluids for use in this invention are fuel-soluble compounds which can be represented by the following formula $$R_i—(R_2—0)_n—R_3 \quad (I)$$

wherein $R_1$ is typically a hydrogen, alkoxy, cycloalkoxy, hydroxy, amino, hydrocarbyl (e.g., alkyl, cycloalkyl, aryl, alkylaryl, aralkyl, etc.), amino-substituted hydrocarbyl, or hydroxy-substituted hydrocarbyl group, $R_2$ is an alkylene group having 2–10 carbon atoms (preferably 2–4 carbon atoms), $R_3$ is typically a hydrogen, alkoxy, cycloalkoxy, hydroxy, amino, hydrocarbyl (e.g., alkyl, cycloalkyl, aryl, alkylaryl, aralkyl, etc.), amino-substituted hydrocarbyl, or hydroxy-substituted hydrocarbyl group, and n is an integer from 1 to 500 representing the number of repeating alkoxy groups. Preferred polyoxyalkylene compounds are comprised of repeating units formed by reacting an alcohol with an alkylene oxide wherein the alcohol and alkylene oxide contain the same number of carbon atoms.

One useful sub-group of polyoxyalkylene compounds is comprised of the hydrocarbyl-terminated poly(oxyalkylene) monools such as are referred to in the passage at column 6, line 20 to column 7 line 14 of U.S. Pat. No. 4,877,416 and references cited in that passage, said passage and said references being incorporated herein by reference as if fully set forth.

A most preferred sub-group of polyoxyalkylene compounds is made up of compounds of formula (I) above wherein the repeating units are comprised substantially of $C_3H_6$—O, and wherein $R_1$ is a hydroxy group and $R_3$ is a hydrogen atom. Polyoxyalkylene compounds useful for this invention which are commercially available include Polyglycol P-1200, Polyglycol L1150, Polyglycol P-400, etc. which are available from the Dow Chemical Company.

The average molecular weight of the polyoxyalkylene compounds used as carrier fluids is preferably in the range of from about 200 to about 5000, more preferably from about 1000 to about 4500, and most preferably from above about 1500 to about 4000. For purposes of this invention, the end groups, $R_1$ and $R_3$, are not critical as long as the overall polyoxyalkylene compound is sufficiently soluble in the fuel compositions and additive concentrates of this invention at the desired concentration to provide homogeneous solutions that do not separate at low temperatures such as −20° C.

The polyoxyalkylene compounds that can be used in practicing this invention may be prepared by condensation of the corresponding alkylene oxides, or alkylene oxide mixtures, such as ethylene oxide, 1,2-propylene oxide, 1,2-butylene oxide, etc. as set forth more fully in U.S. Pat. Nos. 2,425,755; 2,425,845; 2,448,664; and 2,457,139, which documents are incorporated herein by reference as if fully set forth.

Cyclopentadienyl Manganese Tricarbonyl Compounds

Cyclopentadienyl manganese tricarbonyl compounds which can be used in the practice of this invention include cyclopentadienyl manganese tricarbonyl, methylcyclopentadienyl manganese tricarbonyl, dimethylcyclopentadienyl manganese tricarbonyl, trimethylcyclopentadienyl manganese tricarbonyl, tetramethylcyclopentadienyl manganese tricarbonyl, pentamethylcyclopentadienyl manganese tricarbonyl, ethylcyclopentadienyl manganese tricarbonyl, diethylcyclopentadienyl manganese tricarbonyl, propylcyclopentadienyl manganese tricarbonyl, isopropylcyclopentadienyl manganese tricarbonyl, tert-butylcyclopentadienyl manganese tricarbonyl, octylcyclopentadienyl manganese tricarbonyl, dodecylcyclopentadienyl manganese tricarbonyl, ethylmethylcyclopentadienyl manganese tricarbonyl, indenyl manganese tricarbonyl, and the like, including mixtures of two or more such compounds. Preferred are the cyclopentadienyl manganese tricarbonyls which are liquid at room temperature such as methylcyclopentadienylmanganesetricarbonyl, ethylcyclopentadienyl manganese tricarbonyl, liquid mixtures of cyclopentadienyl manganese tricarbonyl and methylcyclopentadienyl manganese tricarbonyl, mixtures of methylcyclopentadienyl manganese tricarbonyl and ethylcyclopentadienyl manganese tricarbonyl, etc. Preparation of such compounds is described in the literature, for example, U.S. Pat. No. 2,818,417, the disclosure of which is incorporated herein in toto.

Proportions

The optimum proportions of the detergent/dispersant to the carrier fluid depends to some extent on the identity of the carrier fluid used. When using the above mineral oil fluids or the above poly-α-olefin carrier fluids (hydrotreated or unhydrotreated) or mixtures of the mineral oil fluids and the PAO, the weight ratio of the detergent/dispersant to the carrier fluid usually will fall in the range of about 0.3:1 to about 1:1. When using one or more polyoxyalkylene compounds either alone or in admixture with a mineral oil carrier, the weight ratio of the detergent/dispersant to the carrier fluid usually will fall in the range of about 0.05:1 to about 0.5:1. When using a combination of the mineral oil, the unhydrotreated poly-α-olefin and the polyoxyalkylene compound, the weight ratio of the detergent/dispersant to the total carrier fluid usually will fall in the range of about 0.25:1 to about 1:1. Departures can be made from any of the foregoing ranges of proportions whenever deemed necessary or desirable without departing from the spirit and scope of this invention, the foregoing ranges of proportions constituting preferred ranges based on presently-available information. It is to be noted that the foregoing proportions are based on the weight of the detergent/dispersant as produced (including unreacted polyolefin associated with the product as produced together with process diluent oil, if any, used during the production process to facilitate the reaction. However the weight of the detergent/dispersant does not include the weight of any additional diluent that may be added to the detergent/dispersant after it has been produced, nor of course does it include the weight of the carrier fluid used therewith. Thus if using a purchased succinimide dispersant which contains a suitable carrier fluid, such as HiTEC® 4403 or 4404 additive (Ethyl Petroleum Additives, Inc.), the dosage used should take into consideration the fact that such products do contain a carrier fluid.

When a mixture of any two or all three types of the preferred carrier fluids is used, the proportions of the respective types of carrier fluids can vary over the entire range of relative proportions. For best results, however, the following proportions on a weight basis are recommended when using mixtures of two such carrier fluids:

For a mixture of 1) mineral oil and 2) hydrotreated or unhydrotreated poly-α-olefin, the weight ratio of 1) to 2) is preferably in the range of about 0.5:1 to about 3:1.

For a mixture of 1) mineral oil and 3) polyoxyalkylene compound, the weight ratio of 1) to 3) is preferably in the range of about 4:1 to about 7:1.

For a mixture of 2) hydrotreated or unhydrotreated poly-α-olefin and 3) polyoxyalkylene compound, the weight ratio of 2) to 3) is preferably in the range of about 0.25:1 to about 4:1.

The proportions of the cyclopentadienyl manganese tricarbonyl compound used in the compositions of this invention is such that the resultant composition when consumed in an engine results in improved intake valve cleanliness as compared intake valve cleanliness of the same engine operated on the same composition except for being devoid of cyclopentadienyl manganese tricarbonyl compound. Thus in general, the weight ratio of detergent/dispersant to manganese in the form of cyclopentadienyl manganese tricarbonyl compound will usually fall within the range of about 3:1 to about 50:1, and preferably within the range of about 6:1 to about 30:1. Here again, the weight of the detergent/dispersant is the weight of the product as produced including unreacted polyolefin associated with the product as produced together with process diluent oil, if any, used during the production process to facilitate the reaction, but excluding the weight of any additional diluent that may be added to the detergent/dispersant after it has been produced, and excluding the weight of the carrier fluid component.

When formulating the fuel compositions of this invention, the additives are employed in amounts sufficient to reduce or inhibit deposit formation in an internal combustion engine. Thus the fuels will contain minor amounts of the above additives A), B) and C)—i.e., succinimide, carrier fluid and manganese compound—that control or reduce formation of engine deposits, especially intake system deposits, and most especially intake valve deposits in spark-ignition internal combustion engines. Generally speaking the fuels of this invention will contain an amount of the succinimide, component A), in the range of about 20 to about 500 ppm, and preferably in the range of about 100 to about 400 ppm; an amount of carrier fluid, component B), in the range of about 20 to about 2000 ppm, and preferably in the range of about 100 to about 1200 ppm; and an amount of manganese in the form of component C) in the range of about 0.0078 to about 0.25 gram of manganese per gallon, and preferably in the range of about 0.0156 to about 0.125 gram of manganese per gallon.

The additives used in formulating the fuels of this invention can be blended into the base fuel individually or in various subcombinations. However, it is definitely preferable to blend all of the components concurrently using an additive concentrate of this invention as this takes advantage of the mutual compatibility afforded by the combination of ingredients when in the form of an additive concentrate. Also use of a concentrate reduces blending time and lessens the possibility of blending errors.

The following Examples in which all parts are by weight illustrate, but are not intended to limit, this invention.

EXAMPLE 1

A fuel additive concentrate is prepared from the following ingredients:

A) 50 parts of a detergent/dispersant formed by reacting polyisobutenylsuccinic anhydride having an acid number of 1.1 (made by reaction of maleic anhydride and polyisobutene having a number average molecular weight of 950) with a commercial mixture approximating triethylene tetramine, in a mole ratio of 2:1 respectively.

B1) 75 parts of naphthenic mineral oil of Witco Corporation H-4053.

B2) 25 parts of 10 cSt unhydrotreated PAO formed by oligomerization of 1-decene.

C) 11.6 parts of methylcyclopentadienyl manganese tricarbonyl

D) 3.5 parts of a demulsifier mixture composed of alkylaryl sulfonates, polyoxyalkylene glycols and oxyalkylated alkylphenolic resins in alkylbenzenes (TOLAD® 9308).

E) 2 parts percent of tetrapropenyl succinic acid supplied as a 50% solution in light mineral oil.

This concentrate is blended with gasolines and with diesel fuels at concentrations of 155 pounds per thousand barrels (ptb).

EXAMPLE 2

A fuel additive concentrate is prepared using components A), B1), B2) and C) as described in Example 1 in the following proportions: 60 parts of A); 60–80 parts of B1); 40–60 parts of B2); and 14 parts of C). In addition, 4 parts of a tertiary butylated phenol antioxidant mixture containing a minimum of 75 percent of 2,6-di-tert-butylphenol, 10–15 percent of 2,4,6-tri-ter-butyl-phenol, and 15–10 percent of 2-tert-butylphenol; 3 parts of Tolad® 286; and 2 parts of tetrapropenyl succinic acid supplied as a 50% solution in light mineral oil are included in the product. This mixture is then blended with gasoline at a rate of 180 pounds per thousand barrels (ptb).

EXAMPLE 3

A fuel additive concentrate is prepared using components A), B1), B2) and C) as described in Example 1 in the following proportions: 75 parts of A); 75–100 parts of B1); 75 parts of B2) and 17.5 parts of C) are used. In addition, 5 parts of a tertiary butylated phenol antioxidant mixture containing a minimum of 75 percent of 2,6-di-tert-butylphenol, 10–15 percent of 2,4,6-tri-tert-butyl-phenol, and 15–10 percent of 2-tert-butylphenol; 3.5 parts of Tolad® 9308; and 2 parts of tetrapropenyl succinic acid supplied as a 50% solution in light mineral oil are included in the finished concentrate. This product mixture is then blended with gasoline at a rate of 225–250 pounds per thousand barrels (ptb).

EXAMPLE 4

A fuel additive concentrate is prepared from the following ingredients:

A) 30 parts of a detergent/dispersant formed by reacting polyisobutenylsuccinic anhydride having an acid number of 1.1 (made by reaction of maleic anhydride and polyisobutene having a number average molecular weight of 950) with a commercial mixture approximating triethylene tetramine, in a mole ratio of 1.8:1 respectively.

B) 60 parts of naphthenic mineral oil (Exxon 900 solvent neutral pale oil).

C) 7 parts of methylcyclopentadienyl manganese tricarbonyl.

D) 2.8 parts of a tertiary butylated phenol antioxidant mixture containing a minimum of 75 percent of 2,6-di-tert-butylphenol, 10–15 percent of 2,4,6-tri-tert-butylphenol, and 15–10 percent of 2-tert-butylphenol (ETHYL® antioxidant 733, Ethyl Corporation).

E) 1.5 parts of a demulsifier mixture composed of alkylaryl sulfonates, polyoxyalkylene glycols and oxyalkylated alkylphenolic resins in alkylbenzenes (TOLAD® 286).

F) 6 parts of an aromatic solvent with a boiling range of 196°–256° C. and a viscosity of 1.7 cSt at 25° C.

G) 0.5 part of tetrapropenyl succinic acid, supplied as a 50% solution in light mineral oil.

This concentrate is blended with gasoline at a concentration of 150 pounds per thousand barrels (ptb).

EXAMPLE 5

Example 4 is repeated using each of the components set forth therein except that 180 ptb of the additive concentrate is formulated with gasoline.

EXAMPLE 6

Example 4 is repeated using each of the components set forth therein except that 225 ptb of the additive concentrate is used in the gasoline mixture.

EXAMPLE 7

A fuel additive concentrate is prepared from the following ingredients:

A) 60 parts of a detergent/dispersant formed by reacting polyisobutenylsuccinic anhydride having an acid number of 1.1 (made by reaction of maleic anhydride and polyisobutene having a number average molecular weight of 950) with a commercial mixture approximating triethylene tetramine, in a mole ratio of 2:1 respectively.

B) 140 parts of polyoxyalkylene compound having an average molecular weight in the range of from about 1500 to about 2000.

C) 14 parts of methylcyclopentadienyl manganese tricarbonyl.

D) 2 parts of a tertiary butylated phenol antioxidant mixture containing a minimum of 75 percent of 2,6-di-tert-butylphenol, 10–15 percent of 2,4,6-tri-tert-butylphenol, and 15–10 percent of 2-tert-butylphenol.

E) 3.4 parts of a demulsifier mixture composed of polyoxyalkylene glycols and oxyalkylated alkylphenolic resins in alkylbenzenes (TOLAD® 9308).

F) 48 parts of Aromatic 150 solvent.

This concentrate is blended with gasolines and with diesel fuels at concentrations of 250 pounds per thousand barrels.

EXAMPLE 8

A fuel additive concentrate is prepared from the following ingredients:

A) 135 parts of a detergent/dispersant formed by reacting polyisobutenylsuccinic anhydride having an acid number of 1.1 (made by reaction of maleic anhydride and polyisobutene having a number average molecular weight of 950) with a commercial mixture approximating triethylene tetramine, in a mole ratio of 2:1 respectively.

B1) 135 parts of naphthenic mineral oil of Witco Corporation 4053-Heavy.

B2) 67.5 parts of 10 cSt hydrotreated PAO formed by oligomerization of 1-decene, and catalytic hydrogenation of the oligomer.

B3) 67.5 parts of polyoxyalkylene compound (Polyglycol 1200; Dow Chemical Co.)

C) 31.5 parts of methylcyclopentadienyl manganese tricarbonyl.

D) 30 parts of a mixture of 15 parts of N,N'-di-sec-butyl-p-phenylenediamine and 15 parts of a tertiary butylated phenol antioxidant mixture containing a minimum of 75 percent of 2,6-di-tert-butylphenol, 10–15 percent of 2,4,6-tri-tert-butylphenol, and 15–10 percent of 2-tert-butylphenol.

E) 10 parts of a demulsifier mixture composed of alkylaryl sulfonates, polyoxyalkylene glycols and oxyalkylated alkylphenolic resins in alkylbenzenes (TOLAD® 286K).

F) 120 parts of an aromatic solvent with a boiling range of 196°–256° C. and a viscosity of 1.7 cSt at 25° C.

G) 5 parts of aspartic acid, N-(3-carboxy-1-oxo-2-propenyl)-N-octadecyl-bis( 2-methylpropyl) ester.

This concentrate is blended with gasolines and with diesel fuels at concentrations of 400, 800, 1200 and 2000 ppm.

EXAMPLE 9

Example 8 is repeated except that component G) is omitted.

EXAMPLE 10

Example 8 is repeated using each of the components set forth therein except that 150 parts of component A) and 105 parts of component F) are used.

EXAMPLE 11

Example 8 is repeated using as component A) 135 parts of a detergent/dispersant formed by reacting polyisobutenylsuccinic anhydride (made by reaction of maleic anhydride and polyisobutene having a number average molecular weight of 750) and an acid number of 1.2 with triethylene tetramine in a mole ratio of 1.8:1 respectively.

EXAMPLE 12

Example 8 is repeated using as component A) 135 parts of a detergent/dispersant formed by reacting polyisobutenylsuccinic anhydride with an acid number of 1.0 (made by reaction of maleic anhydride and polyisobutene having a number average molecular weight of 1200) with triethylene tetramine in a mole ratio of 2.2:1 respectively.

EXAMPLE 13

Example 8 is repeated with the following changes: Component

A) is 170 parts of the detergent/dispersant admixed with 520 parts of 500 Solvent Neutral Oil, the acid number of the polyisobutenylsuccinic anhydride used in making the detergent dispersant is 0.9, and 65 parts of component F) are used.

EXAMPLE 14

Examples 1–13 are repeated except that component C) is ethylcyclopentadienyl manganese tricarbonyl.

EXAMPLE 15

Examples 1–13 are repeated except that component C) is indenyl manganese tricarbonyl (used on an equal weight of manganese basis).

EXAMPLE 16

Examples 1–3 are repeated substituting an equal amount of 10 cSt hydrotreated PAO oligomer (ETHYLFLO 170 oligomer; Ethyl Corporation) as component B2) thereof.

EXAMPLE 17

Examples 8–13 are repeated except that component B2) is 67.5 parts of 10 cSt unhydrogenated PAO produced from 1-decene.

As can be seen from the above examples, it is preferable to include in the fuel compositions and fuel additive concentrates of this invention other types of additives such as antioxidants, demulsifiers, corrosion inhibitors, aromatic solvents, diluent oils, etc.

Antioxidant.

Various compounds known for use as oxidation inhibitors can be utilized in the practice of this invention. These include phenolic antioxidants, amine antioxidants, sulfurized phenolic compounds, and organic phosphites, among others. For best results, the antioxidant should be composed predominately or entirely of either (1) a hindered phenol antioxidant such as 2,6-di-tert-butylphenol, 4-methyl-2,6-di-tert-butylphenol, 2,4-dimethyl-6-tert-butylphenol, 4,4'-methylenebis(2,6-di-tert-butylphenol), and mixed methylene bridged polyalkyl phenols, or (2) an aromatic amine antioxidant such as the cycloalkyl-di-lower alkyl amines, and phenylenediamines, or a combination of one or more such phenolic antioxidants with one or more such amine antioxidants. Particularly preferred for use in the practice of this invention are combinations of tertiary butyl phenols, such as 2,6-di-tert-butylphenol, 2,4,6-tri-tert-butylphenol and o-tert-butylphenol, such as ETHYL® antioxidant 733, or ETHYL® antioxidant 738. Also useful are N,N'-di-lower-alkyl phenylenediamines, such as N,N'-di-sec-butyl-p-phenylenedimine, and its analogs, as well as combinations of such phenylenediamines and such tertiary butyl phenols.

Demulsifier.

A wide variety of demulsifiers are available for use in the practice of this invention, including, for example, organic sulfonates, polyoxyalkylene glycols, oxyalkylated phenolic resins, and like materials. Particularly preferred are mixtures of alkylaryl sulfonates, polyoxyalkylene glycols and oxyalkylated alkylphenolic resins, such as are available commercially from Petrolite Corporation under the TOLAD trademark. One such proprietary product, identified as TOLAD 286K, is understood to be a mixture of these components dissolved in a solvent composed of alkyl benzenes. This product has been found efficacious for use in the compositions of this invention. A related product, TOLAD 286, is also suitable. In this case the product apparently contains the same kind of active ingredients dissolved in a solvent composed of heavy aromatic naphtha and isopropanol. However, other known demulsifiers can be used.

Diluent Oil.

This component of the compositions of this invention can be widely varied inasmuch as it serves the purpose of maintaining compatibility and keeping the product mixture in the liquid state of aggregation at most temperatures commonly encountered during actual service conditions. Thus use may be made of such materials as hydrocarbons, alcohols, and esters of suitable viscosity and which ensure the mutual compatibility of the other components. Preferably the diluent is a hydrocarbon, more preferably an aromatic hydrocarbon. For best results the diluent oil is most preferably an aromatic solvent with a boiling range in the region of 190°–260° C. and a viscosity of 1.5 to 1.9 cSt at 25° C.

Corrosion Inhibitor.

Here again, a variety of materials are available for use as corrosion inhibitors in the practice of this invention. Thus, use can be made of dimer and trimer acids, such as are produced from tall oil fatty acids, oleic acid, linoleic acid, or the like. Products of this type are currently available from various commercial sources, such as, for example, the dimer and trimer acids sold under the HYSTRENE trademark by the Humko Chemical Division of Witco Chemical Corporation and under the EMPOL trademark by Emery Chemicals. Another useful type of corrosion inhibitor for use in the practice of this invention are the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Preferred materials are the aminosuccinic acids or derivatives thereof represented by the formula:

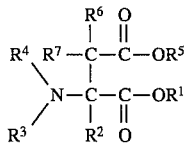

wherein each of $R^1$, $R^2$, $R^5$, $R^6$ and $R^7$ is, independently, a hydrogen atom or a hydrocarbyl group containing 1 to 30 carbon atoms, and wherein each of $R^3$ and $R^4$ is, independently, a hydrogen atom, a hydrocarbyl group containing 1 to 30 carbon atoms, or an acyl group containing from 1 to 30 carbon atoms.

The groups $R^1$, $R^2$, $R^3$, $R^4$, $R^5$, $R^6$ and $R^7$, when in the form of hydrocarbyl groups, can be, for example, alkyl, cycloalkyl or aromatic containing groups. Preferably $R^1$ and $R^5$ are the same or different straight-chain or branched-chain hydrocarbon radicals containing 1–20 carbon atoms. Most preferably, $R^1$ and $R^5$ are saturated hydrocarbon radicals containing 3–6 carbon atoms. $R^2$, either $R^3$ or $R^4$, $R^6$ and $R^7$, when in the form of hydrocarbyl groups, are preferably the same or different straight-chain or branched-chain saturated hydrocarbon radicals. Preferably a dialkyl ester of an aminosuccinic acid is used in which $R^1$ and $R^5$ are the same or different alkyl groups containing 3–6 carbon atoms, $R^2$ is a hydrogen atom, and either $R^3$ or $R^4$ is an alkyl group containing 15–20 carbon atoms or an acyl group which is derived from a saturated or unsaturated carboxylic acid containing 2–10 carbon atoms.

Most preferred is a dialkylester of an aminosuccinic acid of the above formula wherein $R^1$ and $R^5$ are isobutyl, $R^2$ is a hydrogen atom, $R^3$ is octadecyl and/or octadecenyl and $R^4$ is 3-carboxy-1-oxo- 2-propenyl. In such ester $R^6$ and $R^7$ are most preferably hydrogen atoms.

The relative proportions of the various supplemental ingredients used in the additive concentrates and distillate fuels of this invention can be varied within reasonable limits. However, for best results, these compositions should contain from 5 to 35 parts by weight (preferably, from 15 to 25 parts by weight) of antioxidant, from 2 to 20 parts by weight (preferably, from 3 to 12 parts by weight) of demulsifier, and from 1 to 10 parts by weight (preferably, from 2 to 5 parts by weight) of corrosion inhibitor per each one hundred parts by weight of detergent/dispersant present in the composition. The amount of diluent oil (compatibilizing oil) can be varied within considerable limits, e.g., from 5 to 150 parts by weight per hundred parts by weight of the detergent/dispersant. As noted above, the detergent/dispersant can be made in the presence of an ancillary diluent or solvent or such may be added to the detergent/dispersant after it has been produced so as to improve its handleability. Thus, the concentrates and fuels may also contain from 0 to 400, preferably 250 to 400 parts, of ancillary solvent oil per 100 parts by weight of the detergent/dispersant.

The above additive compositions of this invention are preferably employed in gasolines, but are also suitable for use in middle distillate fuels, notably, diesel fuels and fuels for gas turbine engines. The nature of such fuels is so well known to those skilled in the art (and even to many persons unskilled in the art) as to require no further comment. It will of course be understood that the base fuels may contain other commonly used ingredients such as cold starting aids, dyes, metal deactivators, cetane improvers, emission control additives, and the like. Moreover the base fuels may contain oxygenates, such as methanol, ethanol, and/or other alcohols, methyl tert-butyl ether, methyl tert-amyl ether and/or other ethers, and other suitable oxygen-containing substances.

While this invention has been described with reference to use of a fuel-soluble succinimide as the detergent/dispersant, it is contemplated, in view of the results described herein, that similar results can be achieved by replacing the succinimide in whole or in part with an equal quantity of one or more fuel-soluble acyclic hydrocarbyl-substituted polyamines. Such compounds and procedures by which they can be prepared are described for example in U.S. Pat. Nos. 3,438,757; 3,454,555; 3,574,576; 3,671,511; 3,746,520; 3,844,958; 3,852,258; 3,864,098; 3,876,704; 3,884,647; 3,898,056; 3,931,024; 3,950,426; 3,960,515; 4,022,589; 4,039,300; 4,168,242; 4,832,702; 4,877,416; 5,028,666; 5,034,471; in PCT applications WO 86/05501 published 25 Sep. 1986; WO 88/03931 published 2 Jun. 1988; and WO 90/10051 published 7 Sep. 1990; in EP Patent No.244,616 B1; and in EPO Publication Nos. 382,405; 384,086; and 389,722. The complete disclosures of each of the foregoing documents are incorporated herein by reference. The preferred components of this type are the fuel-soluble polyisobutenyl polyamines derived from aliphatic polyamines such as ethylene diamine, diethylene triamine, hexamethylene diamine, triethylene tetramine, N-(2-aminoethyl)ethanolamine, and the like.

Thus this invention contemplates the provision of fuel additive concentrates and liquid hydrocarbonaceous fuel compositions containing a fuel-soluble acyclic hydrocarbyl-substituted polyamine, a fuel-soluble liquid carrier or induction aid therefor, and a fuel-soluble cyclopentadienyl manganese tricarbonyl compound. In such compositions all description hereinabove—except that specifically pertaining to the fuel-soluble succinimide detergent or a fuel-soluble product formed by reaction between (1) at least one polyamine and (2) at least one acyclic hydrocarbyl-substituted succinic acylating agent—is applicable, and is here iterated, and is here incorporated by reference as if fully set forth at this point of the specification.

A typical polyisobutenyl polyamine for use in these various embodiments is Lubrizol®8195 additive. According to the manufacturer, this product has a nitrogen content of 0.31 wt %, a TBN of 12.2, a specific gravity at 15.6° C. of 0.882, a viscosity at 40° C. of 35.2 cSt, a viscosity at 100° C. of 7.4 cSt, and a PMCC flash point of 41° C., and yields no sulfated ash.

It will be readily apparent that this invention is susceptible to considerable modification in its practice. Accordingly, this invention is not intended to be limited by the specific exemplifications presented hereinabove. Rather, what is intended to be covered is within the spirit and scope of the appended claims.

What is claimed is:

1. A fuel additive concentrate comprising:

a) fuel-soluble succinimide detergent/dispersant formed by reaction between (i) a mixture of ethylene polyamines having an average of about 3 to about 4 nitrogen atoms per molecule and (ii) at least one substituted succinic acylating agent in which the substituent is derived from polyisobutene containing an average of 50 to 100 carbon atoms;

b) a fuel-soluble mineral oil carrier or induction aid having a volatility of 50% or less; and c) a fuel-soluble cyclopentadienyl manganese tricarbonyl compound that exists as a liquid at 25° C.; in proportions effective to reduce the weight of intake valve deposits in a spark-ignition internal combustion engine operated on a gasoline-based fuel containing an intake valve deposit-controlling amount of said fuel additive concentrate to below the weight of intake valve deposits in said engine operated in the same manner on the same gasoline-based fuel except that it is devoid of cyclopentadienyl manganese tricarbonyl compound.

2. A concentrate according to claim 1 further comprising at least one fuel-soluble antioxidant; at least one fuel-soluble demulsifier; and at least one fuel-soluble corrosion inhibitor.

3. A concentrate according to claim 2 wherein said mixture of ethylene polyamines has an average of about 4 nitrogen atoms per molecule; wherein said acylating agent and said mixture of ethylene polyamines are reacted in a mole ratio of about 1.8:1, respectively; wherein said cyclopentadienyl manganese tricarbonyl compound is methylcyclopentadienyl manganese tricarbonyl; wherein said antioxidant is a tertiary butylated phenol antioxidant mixture containing a minimum of 75 wt % of 2,6-di-tert-butylphenol; wherein said demulsifier is a mixture comprising alkylaryl sulfonates, polyoxyalkylene glycols and oxyalkylated alkylphenolic resins; and wherein said corrosion inhibitor is tetrapropenyl succinic acid.

4. A fuel composition for internal combustion engines, said fuel composition comprising a gasoline-based fuel and an intake valve deposit controlling amount of a combination of:

a) a fuel-soluble succinimide detergent dispersant formed by reaction between (i) a mixture of ethylene polyamines having an average of about 3 to about 4 nitrogen atoms per molecule and (ii) at least one substituted succinic acylating agent in which the substituent is derived from polyisobutene containing an average of 50 to 100 carbon atoms;

b) a fuel-soluble mineral oil carrier or induction aid having a volatility of 50% or less; and c) a fuel-soluble cyclopentadienyl manganese tricarbonyl compound that exists as a liquid at 25° C.;

in proportions effective to reduce the weight of intake valve deposits in a spark-ignition internal combustion engine operated on said fuel composition to below the weight of intake valve deposits in said engine operated in the same manner on the same fuel composition except that it is devoid of cyclopentadienyl manganese tricarbonyl compound.

5. A fuel composition according to claim 4 further comprising at least one fuel-soluble antioxidant; at least one fuel-soluble demulsifier; and at least one fuel-soluble corrosion inhibitor.

6. A fuel composition according to claim 5 wherein said mixture of ethylene polyamines has an average of about 4 nitrogen atoms per molecule; wherein said acylating agent and said mixture of ethylene polyamines are reacted in a mole ratio of about 1.8:1, respectively; wherein said cyclopentadienyl manganese tricarbonyl compound is methylcyclopentadienyl manganese tricarbonyl; wherein said antioxidant is a tertiary butylated phenol antioxidant mixture containing a minimum of 75 wt % of 2,6-di-tert-butylphenol; wherein said demulsifier is a mixture comprising alkylaryl sulfonates, polyoxyalkylene glycols and oxyalkylated alkylphenolic resins; and wherein said corrosion inhibitor is tetrapropenyl succinic acid.

7. A method of controlling intake valve deposits in a spark-ignition internal combustion engines operated on gasoline, which method comprises providing as the fuel therefor, a fuel composition comprising a gasoline-based fuel and an intake valve deposit controlling amount of a combination of:

a) a fuel-soluble succinimide detergent dispersant formed by reaction between (i) a mixture of ethylene polyamines having an average of about 3 to about 4 nitrogen atoms per molecule and (ii) at least one substituted succinic acylating agent in which the substituent is derived from polyisobutene containing an average of 50 to 100 carbon atoms;

b) a fuel-soluble mineral oil carder or induction aid having a volatility of 50% or less; and c) a fuel-soluble cyclopentadienyl manganese tricarbonyl compound that exists as a liquid at 25° C.;

in proportions effective to reduce the weight of intake valve deposits in said spark-ignition internal combustion engine operated on said fuel composition to below the weight of intake valve deposits in said engine operated in the same manner on the same fuel composition except that it is devoid of cyclopentadienyl manganese tricarbonyl compound.

8. A method according to claim 7 wherein said fuel composition further comprises at least one fuel-soluble antioxidant; at least one fuel-soluble demulsifier; and at least one fuel-soluble corrosion inhibitor.

9. A method according to claim 8 wherein said mixture of ethylene polyamines has an average of about 4 nitrogen atoms per molecule; wherein said acylating agent and said mixture of ethylene polyamines are reacted in a mole ratio of about 1.8:1, respectively; wherein said cyclopentadienyl manganese tricarbonyl compound is methylcyclopentadienyl manganese triearbonyl; wherein said antioxidant is a tertiary butylated phenol antioxidant mixture containing a minimum of 75 wt % of 2,6-di-tert-butylphenol; wherein said demulsifier is a mixture comprising alkylaryl sulfonates, polyoxyalkylene glycols and oxyalkylated alkylphenolic resins; and wherein said corrosion inhibitor is tetrapropenyl succinic acid.

* * * * *